US007540069B2

(12) United States Patent
Okamoto

(10) Patent No.: US 7,540,069 B2
(45) Date of Patent: Jun. 2, 2009

(54) BINDING BAND

(75) Inventor: Isao Okamoto, Moriguchi (JP)

(73) Assignee: Nichido Kogyo Kabushiki Kaisha, Osaka (JP)

( * ) Notice: Subject to any disclaimer, the term of this patent is extended or adjusted under 35 U.S.C. 154(b) by 803 days.

(21) Appl. No.: 11/043,660

(22) Filed: Jan. 26, 2005

(65) Prior Publication Data

US 2005/0262672 A1 Dec. 1, 2005

(30) Foreign Application Priority Data

May 25, 2004 (JP) ..... 2004-154157

(51) Int. Cl.

| | |
|---|---|
| ***B65D 63/00*** | (2006.01) |
| ***B65D 63/10*** | (2006.01) |
| ***B65D 63/18*** | (2006.01) |
| *F16L 3/233* | (2006.01) |
| *F16L 3/22* | (2006.01) |

(52) U.S. Cl. ..... 24/16 PB; 24/716; 248/690; 248/691; 248/692; 248/74.3

(58) Field of Classification Search ..... 24/716, 24/905, 907, 318, 319, 343, 344, 345; 248/690, 248/691, 692, 74.3

See application file for complete search history.

(56) References Cited

U.S. PATENT DOCUMENTS

| | | | | |
|---|---|---|---|---|
| 3,147,522 | A | 9/1964 | Schumm | |
| 3,147,523 | A | 9/1964 | Logan | |
| 3,206,813 | A * | 9/1965 | Schumm | 24/16 PB |
| 3,206,814 | A * | 9/1965 | Schumm | 24/16 PB |
| 3,576,054 | A | 4/1971 | Rynk | |
| 3,672,004 | A | 6/1972 | Smith | |
| 3,837,047 | A * | 9/1974 | Bunnell | 24/16 PB |
| 4,272,047 | A * | 6/1981 | Botka | 248/74.3 |
| 4,910,831 | A | 3/1990 | Bingold | |
| 4,951,362 | A | 8/1990 | Denemark et al. | |
| 6,109,673 | A | 8/2000 | Olshausen | |
| 6,325,577 | B1 | 12/2001 | Anderson | |

FOREIGN PATENT DOCUMENTS

| | | |
|---|---|---|
| CN | 1468785 | 1/2004 |
| DE | 12 31 614 B | 12/1966 |
| DE | 12 35 220 B | 2/1967 |
| DE | 2046011 | 4/1971 |
| DE | 77 24 913 | 12/1977 |
| EP | 1 600 397 A1 | 11/2005 |
| EP | 05 74 1469 | 5/2007 |
| EP | 05741469.0 | 8/2007 |
| FR | 2 393 512 A | 12/1978 |
| GB | J21911 A | 3/1910 |
| GB | 691 679 A | 5/1953 |
| JP | 38-16457 Y1 | 8/1963 |

(Continued)

*Primary Examiner*—Robert J Sandy
(74) *Attorney, Agent, or Firm*—Ditthavong Mori & Steiner, P.C.

(57) ABSTRACT

A binding band comprises a band part, a pendant hook part provided at one end of the band part, and an enclosed-wall part provided at the other end of the band part and having a passage through which the band part is vertically passed. The enclosed-wall part has a slit through which the band part is inserted into the passage from the side.

10 Claims, 5 Drawing Sheets

FOREIGN PATENT DOCUMENTS

| | | | |
|---|---|---|---|
| JP | 5330200 | U | 3/1978 |
| JP | 60-50164 | U | 4/1985 |
| JP | 05018377 | U | 3/1993 |
| JP | 07028923 | U | 5/1995 |
| JP | 10-318439 | A | 12/1998 |
| JP | 2001112605 | A | 4/2001 |
| JP | 2003 237823 | | 8/2003 |
| JP | 2004097324 | A | 4/2004 |
| WO | WO 97/37557 | | 10/1997 |
| WO | 0121500 | A1 | 3/2001 |

* cited by examiner

BINDING BAND

BACKGROUND OF THE INVENTION

1. Field of the Invention

The present invention relates to a binding band and more particularly, it relates to a binding band which can be hooked on a wall or a column.

2. Description of the Background Art

The conventional binding band is disclosed in Japanese Unexamined Patent Publication No. 2003-237823, for example.

The binding band comprises a band part having a plurality of long and thin teeth continuously provided in the longitudinal direction, and a framed buckle having a hole at one end of the band part, to which the band part is inserted and a locking tooth which engages with the tooth, at a part of the hole.

The above document discloses a binding band in which a band part does not easily come off but can be pulled out by a simple operation.

The conventional binding band was constituted as described above. Although the band part of the binding band was devised in many ways, treatment after binding was not considered.

SUMMARY OF THE INVENTION

The present invention was made in view of the above problems and it is an object of the present invention to provide a binding band in which treatment after an object is bound by the binding band is considered.

A binding band according to the present invention comprises a band part, a pendant hook part provided at one end of the band part and an enclosed-wall part provided at the other end of the band part and having a passage through which the band part is vertically passed, in which the enclosed-wall part has a slit through which the band part is inserted into the passage from the side.

The band part can be inserted in the enclosed-wall part through the slit and the binding band can be hooked at any external position with a pendant hook part provided at one end of the band part.

As a result, there can be provided the binding band in which treatment after an object is bound with the binding band is considered.

Preferably, the slit has a first opening dimension, the band part comprises a neck part having a width dimension smaller than the first opening dimension and a band body having a third width dimension larger than the first opening dimension, and the passage has a width dimension larger than the third width dimension.

Further preferably, the pendant hook part has a fourth width dimension larger than the third width dimension.

Still further preferably, a plurality of continuous teeth are provided in the band body and the enclosed-wall part comprises a locking part which engages with the tooth.

Still further preferably, the neck part is provided at one end of the band part and between the band body and the pendant hook part.

Besides, the pendant hook part may be rotated with respect to the band part or may be detachable with respect to the band part.

DESCRIPTION OF THE PREFERRED EMBODIMENTS

Figure 1:
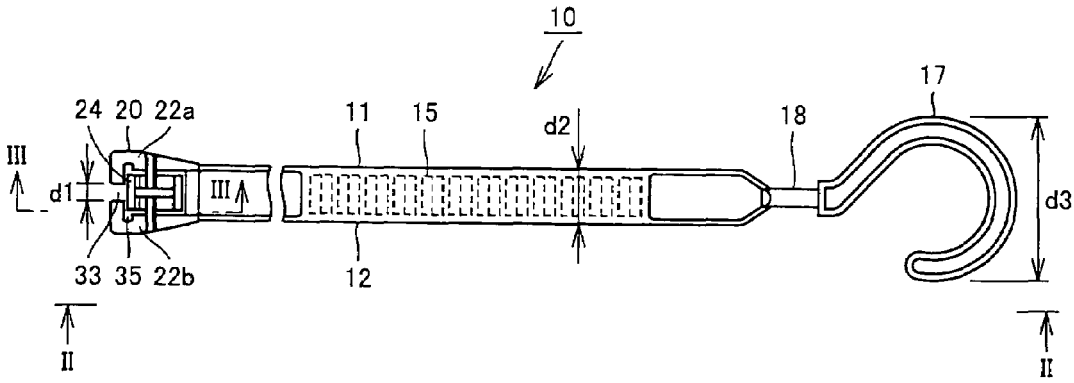
FIG. 1 is a plan view showing a binding band according to the present invention.
Figure 2:
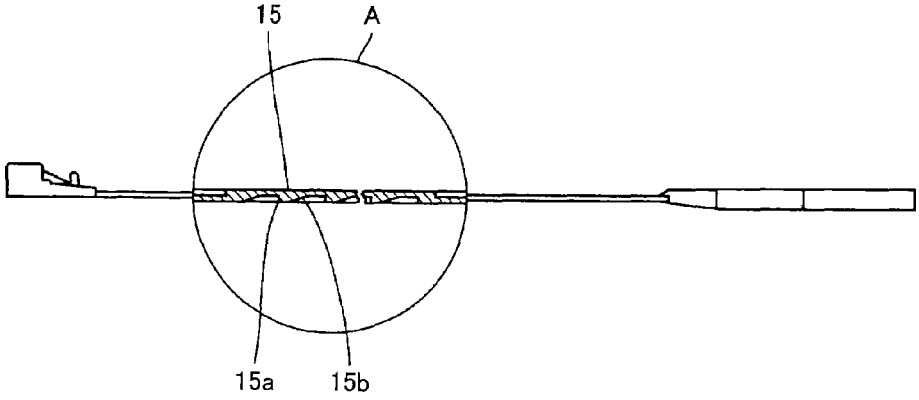
FIG. 2 is a side view showing the binding band according to the present invention.
Figure 3:
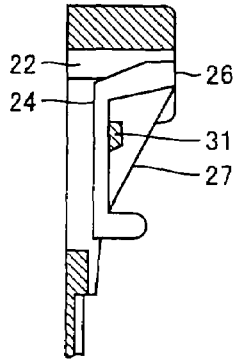
FIG. 3 is a view showing a detail of an enclosed-wall part.

Hereinafter, an embodiment of the present invention is described with reference to the drawings. FIG. 1 is a plan view showing a binding band according to one embodiment of the present invention, FIG. 2 is a sectional view taken from a part shown by arrows II-II in FIG. 1, FIG. 3 is a sectional view taken from a part shown by arrows III-III in FIG. 1. In addition, a part (shown by A) is enlarged so as to be easily understood in FIG. 2.

Referring to FIGS. 1 to 3, a binding band 10 comprises a band part 11, an enclosed-wall part 20 provided at one end of the band part 11, and a hook part 17 provided at the other end of the band part 11. The band part 11 comprises a band body 12 and a neck part 18 provided on the side of the hook part 17 of the band part 11. The neck part 18 has a cylindrical shape and the band part 11 has a flat shape.

The band part 11 has a predetermined width d2 and a plurality of teeth 15 continuously provided in the longitudinal direction in the flat band body 12 as shown in FIG. 1. Referring to the part shown by A in FIG. 2, the tooth 15 has a vertical surface 15*a* perpendicular to the surface of the band body 12 and a slanted surface 15*b* which is gradually decreased in thickness toward the neck part 18.

The enclosed-wall part 20 has a passage 35 inside, through which the band part 11 is passed. A thickness dimension of the passage 35 is almost the same as that of the band part 11 or slightly larger than that. A slit 33 having a width dimension d1 smaller than the width d2 of the band part 11 is formed at a tip end of the passage 35 in the enclosed-wall part 20. In order to form the passage 35 and the slit 33, the enclosed-wall part 20 comprises a pair of portal wall parts 22*a* and 22*b* which are oppositely provided at an interval. A space is provided between the pair of wall parts 22*a* and 22*b* and a locking part 24 is provided at the space.

The locking part 24 is elastically supported on the pair of wall parts 22*a* and 22*b* by a support part 31 in a state in which a space part is opened around. In addition, the locking part 24 is arranged so as to intersect with the passage 35.

Here, the width d1 of the slit 33 is larger than that of the neck part 18. Therefore, the neck part 18 and the subsequent band body 12 of the binding band 10 are passed through the passage 35 of the enclosed-wall part 20 as will be described below with reference to FIGS. 4 to 6.

The locking part 24 has a locking tooth 26 which abuts on the vertical surface 15*a* of the tooth 15 provided in the band part 11. A rib 27 (refer to FIG. 3) is provided at the locking part 24 so as to retain the locking tooth 26 at a predetermined position with respect to the support part 31.

As described above, the tooth 15 provided in the band body 12 has the slanted surface 15*b* which is gradually increased in thickness from the neck part 18 and the vertical surface 15*a* succeeding to the slanted surface. When the band body 12 is passed through the passage 35, since it engages with the locking part 24 in the increasing order of thickness, an object can be easily bound by pulling the pendant hook 17 which was passed through the passage 35. In addition, once the object is bound and the tooth 15 engages with the locking tooth 26, it is difficult to release the engagement in the reverse direction.

Figure 4:
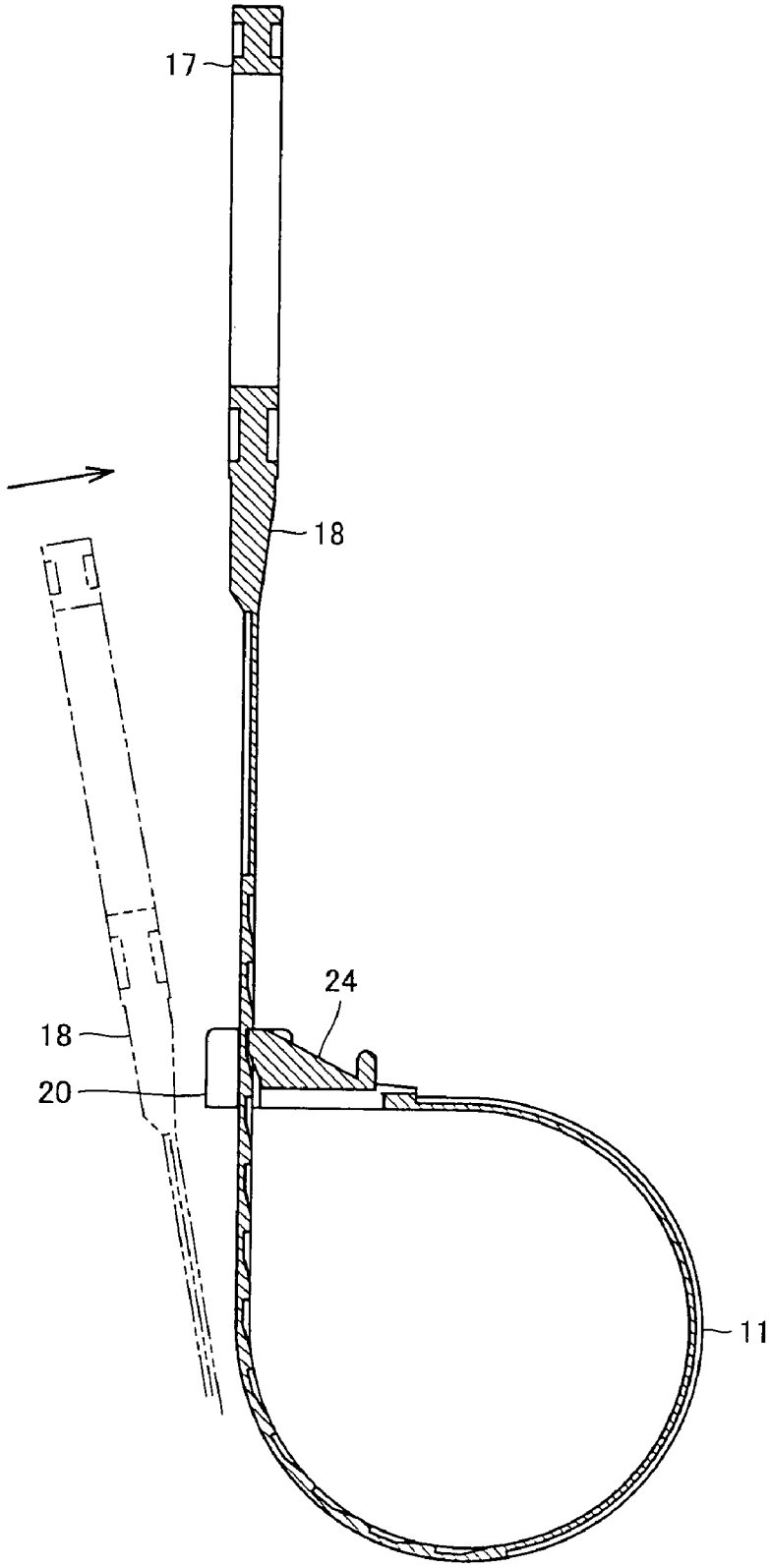
FIG. 4 is a view showing a state in which the binding band is used.

Next, a description is made of how to use the binding band. FIG. 4 is a view showing a state in which the binding band 10 binds the object and the locking tooth 26 of the locking part 24 engages with the tooth 15 of the band part 11. As shown by an arrow in FIG. 4, the hook part 17 and the neck part 18 are brought close to the enclosed-wall part 20, and the neck part 18 is passed through the slit 33 and then the band body 12 is passed through the passage 35.

Figure 5:
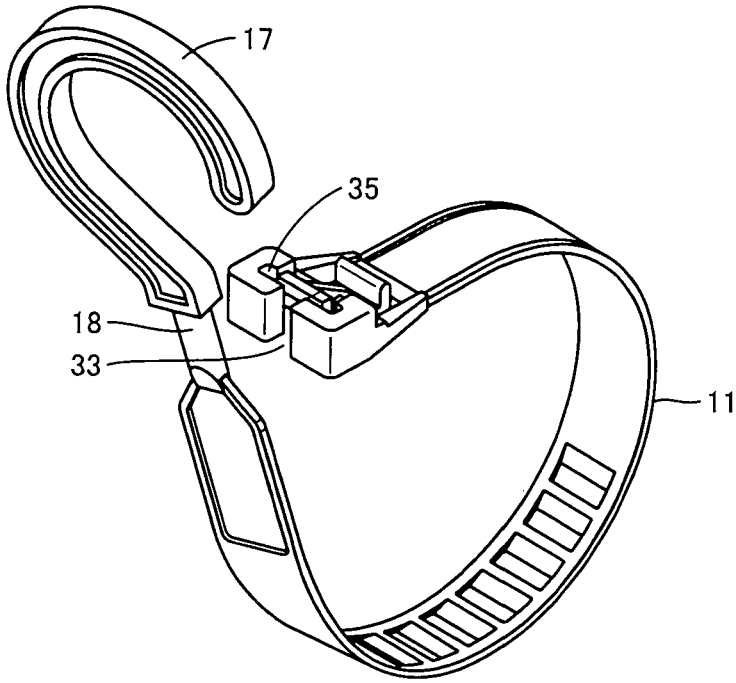
FIG. 5 is a view showing a procedure for passing a band part through the enclosed-wall part.

A concrete inserting method is described with reference to FIGS. 5 and 6. FIG. 5 is a view showing a state in which the neck part 18 of the binding band 10 is brought close to the slit 33 and FIG. 6 is a view showing a state in which the neck part 18 of the binding band 10 is passed through the slit 33.

Figure 6:
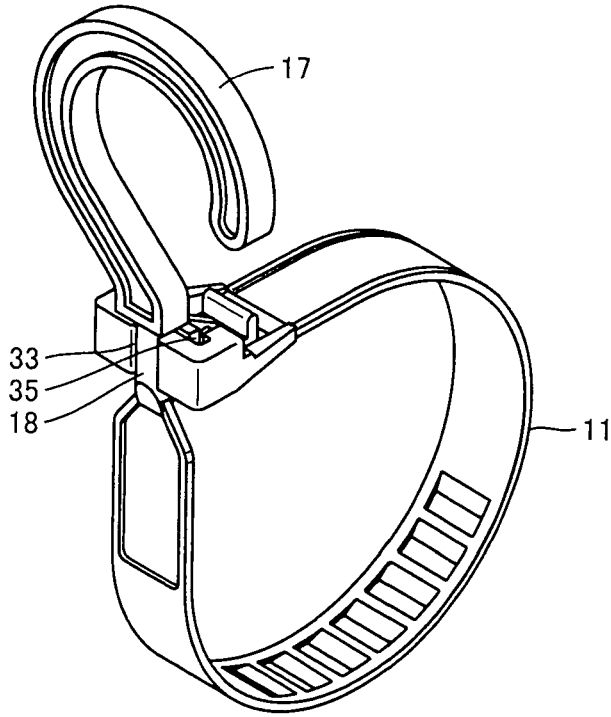
FIG. 6 is a view showing a procedure for passing the band part through the enclosed-wall part.

Referring to FIGS. 5 and 6, the neck part 18 of the binding band 10 is put in the slit 33 of the enclosed-wall part 20 and then the band part 11 is put through the passage 35. Then, the pendant hook 17 is pulled. As a result, as shown in FIG. 4, the band part 11 is integrated with the enclose-wall part 20. The object bound by the band part 11 is not shown.

Referring to FIG. 4, since the binding band 10 has the pendant hook part 17, the pendant hook part 17 can be hooked on any projection after the object is bound.

Next, the pendant hook part 17 is described. As shown in FIG. 1, the pendant hook part 17 is in the shape of a hook. Since the hook part 17 of the binding band 10 is hook-shaped, the binding band 10 can be hooked on any external convex part.

Figure 7:
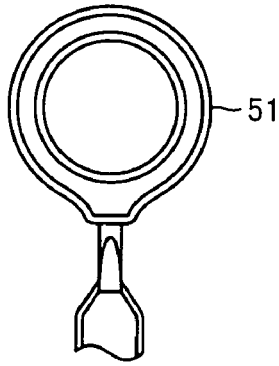
FIG. 7 is a view showing another embodiment of a pendant hook part.

In addition, instead of the hook-shaped pendant hook part 17, a ring-shaped pendant hook 51 may be used as shown in FIG. 7. In the case of the ring-shaped hook part 51, the binding band 10 can be easily hooked on a projected nail, bar and the like and it is not liable to get unhooked even when it is shaken in some degree.

Although the pendant hook part 17 is in the shape of a hook on a flat surface of the band part 11 in FIG. 1, the present invention is not limited to this and the hook of the pendant hook part 17 may be faced in any direction with respect to the flat surface of the band part 11.

Figure 8:
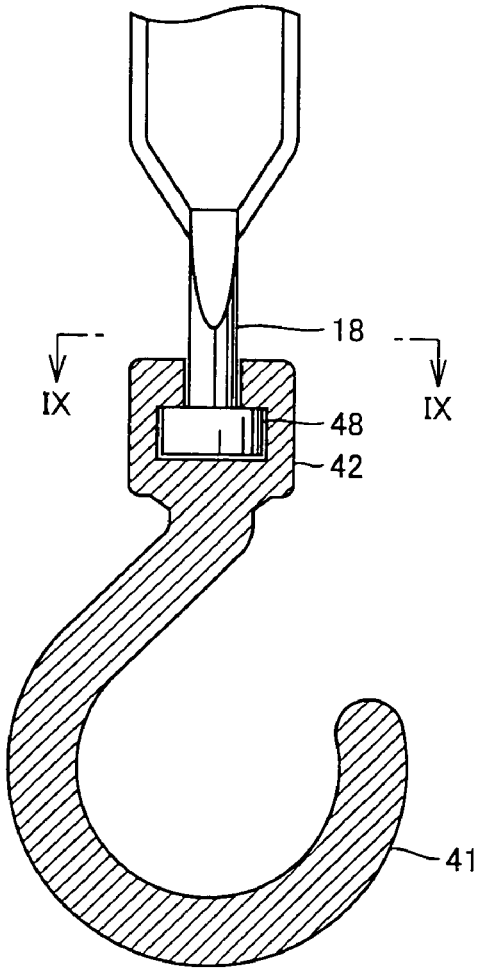
FIG. 8 is a view showing another embodiment in which the pendant hook part engages with a neck part.
Figure 9:
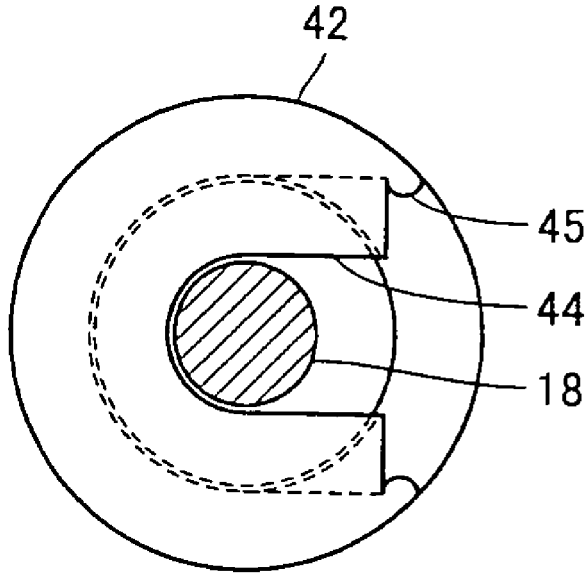
FIG. 9 is a view taken from a part shown by arrows IX-IX in FIG. 8.

Next, another embodiment of the present invention is described. FIGS. 8 and 9 show views of anther embodiment of the present invention. FIG. 8 is a sectional view showing a vicinity of a hook part 41 and a neck part 18 according to another embodiment, and FIG. 9 is a view taken from a part shown by arrows IX-IX in FIG. 8.

Referring to FIGS. 8 and 9, the pendant hook part 41 can be rotated in any direction with respect to the neck part 18 and can be dismounted from the neck part 18 in this embodiment.

Referring to FIGS. 8 and 9, the neck part 18 has a cylindrical neck supporting part 48 whose diameter is larger than that of the neck part 18, at its tip end. Meanwhile, the pendant hook part 41 has a hook part fixing part 42 at a part in which the fixing part 42 engages with the neck part 18.

As shown in FIG. 9, the hook part fixing part 42 has a neck part supporting part 44 for rotatably retaining the cylindrical neck supporting part 48 at the end on the side of the neck part 18. The neck part supporting part 44 is U-shaped so that the neck part 18 can be dismounted from one direction in its circumferential direction. In addition, a stopper 45 is provided at the hook part fixing part 42 so that the U-shaped configuration may not be rotated in the circumferential direction.

Since the neck part 18 and the pendant hook part 17 have such configurations, the pendant hook part 17 can be faced in any direction with respect to the direction of the flat part of the band part 11. Furthermore, the pendant hook part 17 may be mounted on the neck part 18 after the object is bound with the binding band and the bound object may be retained at any position.

Although the description was made of the example in which the pendant hook part is in the shape of a hook or a ring in the above embodiments, the present invention is not limited to the above shapes and any configuration may be employed provided that it can be retained at the outside.

Furthermore, the description was made of the case in which the neck part is cylindrical in the above embodiments, the present invention is not limited to this and it may be flat or have configuration changed from a flat shape to a cylindrical shape.

Still further, although the description was made of the case in which the locking tooth is locked after engagement with the tooth in the above embodiments, the present invention is not limited to this and it may be constituted so as to be unlocked and released.

Although the embodiments of the present invention were made with reference to the drawings, the present invention may not be limited to the illustrated embodiments. Various kinds of modifications or variations can be added to the above embodiments in the same scope or the equivalent scope of the present invention.

The present invention can be advantageously used as a binding band which can be hanged on a wall or a column.

What is claimed is:

1. A binding band comprising:

a band part;

a pendant hook part provided at one end of said band part; and an enclosed-wall part provided at the other end of said band part and having a passage through which said band part is passed, wherein said enclosed-wall part has a slit through which said band part is inserted into said passage from a side, wherein said band part has a cylindrical neck supporting part, and wherein said pendant hook part has a fixing part rotatably retaining said cylindrical neck supporting part.

2. The binding band according to claim 1, wherein said slit has a first opening dimension, said band part comprises a neck part having a width dimension smaller than said first opening dimension and a band body having a third width dimension larger than the first opening dimension, and said passage has a width dimension larger than the third width dimension.

3. The binding band according to claim 2, wherein said pendant hook part has a fourth width dimension larger than said third width dimension.

4. The binding band according to claim 2, wherein a plurality of continuous teeth are provided in said band body, and said enclosed-wall part comprises a locking part which engages with said tooth.

5. The binding band according to claim 2, wherein said neck part is provided at one end of said band part and between said band body and said pendant hook part.

6. The binding band according to claim 1, wherein said pendant hook part is pivotally connected to said band part.

7. The binding band according to claim 1, wherein said pendant hook part is detachable from and reattachable to said band part.

8. The binding band according to claim 1, wherein said fixing part has a U-shaped neck part supporting part configured to allow said pendant hook part be detachable from and reattachable to said band part.

9. The binding band according to claim 1, wherein, when in a non-bent state, said band part is elongated in a first direction, and wherein said passage extends in a second direction that is perpendicular to the first direction.

10. The binding band according to claim 1, wherein:

a plurality of teeth is provided in said band body;

said enclosed-wall part comprises a locking part configured to engage with a tooth of said plurality of teeth; and said teeth of said plurality of teeth are recesses extending within said band body.

* * * * *